US006126424A

United States Patent [19]

Wenker et al.

[11] Patent Number: 6,126,424

[45] Date of Patent: Oct. 3, 2000

[54] TRANSISTION VALVING FOR GEROTOR MOTORS

[75] Inventors: Wayne B. Wenker; Marvin L. Bernstrom, both of Eden Prairie, Minn.

[73] Assignee: Eaton Corporation, Cleveland, Ohio

[21] Appl. No.: 09/081,248

[22] Filed: May 19, 1998

[51] Int. Cl.[7] ..... F01C 1/02

[52] U.S. Cl. ..... 418/61.3; 418/190

[58] Field of Search ..... 418/61.3, 190

[56] References Cited

U.S. PATENT DOCUMENTS

| | | | |
|---|---|---|---|
| 1,728,529 | 9/1929 | Butler | 418/190 |
| 2,344,628 | 3/1944 | Monahan | 418/190 |
| 3,981,646 | 9/1976 | Bottoms | 418/190 |
| 4,145,167 | 3/1979 | Baatrup | 418/61 B |
| 4,558,720 | 12/1985 | Larson et al. | 418/61.3 X |
| 5,215,453 | 6/1993 | Petersen et al. | 418/61.3 |

*Primary Examiner*—Hoang Nguyen
*Attorney, Agent, or Firm*—L. J. Kasper

[57] ABSTRACT

A rotary fluid pressure device (11) comprising a gerotor motor of the type including a spool valve member (51) cooperating with a housing (13) to define a nominal valve overlap (X). The motor has a drive shaft (53) for transmitting the rotational movement of a gerotor star (27) to the spool valve member (51) and output shaft (49), such that, under high torque loads, the drive shaft (53) is subjected to drive twist, which would normally effect valve timing. In accordance with the invention, the spool valve member (51) and the housing are provided with a valve overlap (Y) which is substantially greater than the nominal overlap (X). The star (27) defines, on its profile (85), first (87) and second (89) recesses which permit communication between the minimum (30) and maximum (32) volume transition chambers and the respective expanding (29) and contracting (31) volume chambers (FIG. 8). The result is an improvement in both mechanical and volumetric efficiency, as well as smoother operation at low speed and high pressure.

6 Claims, 7 Drawing Sheets

TRANSISTION VALVING FOR GEROTOR MOTORS

STATEMENT REGARDING FEDERALLY SPONSORED RESEARCH OR DEVELOPMENT

Not Applicable

CROSS-REFERENCE TO RELATED APPLICATIONS

Not Applicable

BACKGROUND OF THE DISCLOSURE

MICROFICHE APPENDIX

Not Applicable

The present invention relates to rotary fluid pressure devices such as low-speed, high-torque gerotor motors, and more particularly, to improved spool valve type gerotor motors.

Low-speed, high-torque gerotor motors are typically classified, in regard to their method of valving, as being "spool valve" motors or "disc valve" motors. As used herein, the term "spool valve" refers to a generally cylindrical valve member in which the valving action occurs between the cylindrical outer surface of the spool valve, and the adjacent internal cylindrical surface ("bore") of the surrounding housing. By way of contrast, the term "disc valve" refers to a valve member which is generally disc-shaped, and the valving action occurs between a transverse surface (perpendicular to the axis of rotation) of the disc valve and an adjacent transverse surface.

Although the present invention may be utilized with gerotor motors of various types of valve arrangements, it is especially suited for use with spool valve motors, and will be described in connection therewith. Furthermore, the invention is especially suited for use with a spool valve motor in which the spool valve is rotated by the main torque transmitting drive shaft, and will be described in connection therewith.

Also, although the present invention may be utilized with gerotor motors of various sizes and various flow and pressure ratings, it should be noted that the use of spool valves has typically been limited to smaller motors, having relatively lower flow and pressure ratings. This has been true partly because of the inherent limitations in spool valve motors wherein there is a radial clearance between the spool valve and the adjacent cylindrical surface or bore of the housing. This radial clearance provides a cross port leakage path which can be eliminated, but only with great difficulty, unlike in the case of disc valve motors, wherein the adjacent valving surfaces are biased into sealing engagement. However, it is becoming more typical for customers (e.g., vehicle manufacturers) to want to use spool valve motors in operating conditions of relatively low speed and relatively high torque. For example, the subject embodiment of the invention is now regularly being utilized, in development, at 5 to 10 rpm or less, and at pressure differentials of about 3000 psi., producing output torques in excess of 5000 lb.-in.

Among the performance characteristics which are considered quite important in low-speed, high-torque gerotor motors are volumetric efficiency and smooth operation, which are somewhat related to each other, Volumetric efficiency may be viewed as the ratio of the actual instantaneous speed of the motor (under certain flow and pressure conditions) to the theoretical instantaneous speed (under the same flow and pressure conditions. When the motor is being operated at a very low speed (low flow), and at a fairly high torque (high pressure), if there is a substantial amount of leakage, thus reducing the volumetric efficiency, the motor will probably run rough, i.e., the torque and speed will not remain consistent but will vary noticeably. Such inconsistency will typically result in rough operation of the associated piece of equipment, which is not acceptable to most customers or to the vehicle operators.

Another important performance characteristic of a gerotor motor is the mechanical efficiency, which may be viewed as the ratio of the actual output of the motor, in terms of torque, to the theoretical torque which should result from the pressure drop across the motor. As is well understood by those skilled in the art, friction is one of the main causes for loss of mechanical efficiency, for example, the frictional losses in the various spline connections, etc. Unfortunately, it is common in gerotor motors that whatever increases volumetric efficiency (e.g., closer clearances) reduces mechanical efficiency, and vice versa.

In many spool valve motor designs, the spool valve and the motor output shaft are formed integrally, with torque output of the gerotor gear set being transmitted to the output shaft by means of a dogbone drive shaft. At relatively low pressures, the various valve passages on the spool valve and in the housing achieve proper communication with each other, and the fluid is communicated to and from the gerotor gear set as intended. However, as the operating pressures rise, the torque being transmitted causes the dogbone shaft to "twist", a phenomenon which is generally understood by those skilled in the art. As the dogbone twists (perhaps as much as one or two degrees or more) under relatively high torque loads, the timing of the communication of each spool passage and its adjacent housing passage is no longer correct, relative to the then-current condition of its associated volume chamber in the gerotor gear set.

In other words, what is happening in the spool valving "lags" behind what is happening in the volume chambers of the gerotor gear set. By way of example only, as one of the volume chambers becomes a maximum volume transition chamber (which will be illustrated in greater detail subsequently), the spool valving will continue for one or two more degrees of rotation to communicate high pressure fluid into that volume chamber, the volume of which is not changing. The instantaneous result will be that the volume chamber has begun to shrink while still communicating with high pressure. Then the valving shuts off and the chamber shrinks further, and because of overlap in the valving, with no way to relieve pressure in the chamber, the fluid pressure will rise rapidly creating a pressure pulse or spike in that volume chamber. Such incorrect timing will result in a number of problems in the gerotor, each of which will have a further detrimental effect on volumetric efficiency and motor smoothness.

BRIEF SUMMARY OF THE INVENTION

Accordingly, it is an object of the present invention to provide a gerotor motor, especially of the spool valve type, which can be operated at relatively high pressure and torque with less deterioration of volumetric and mechanical efficiency and motor smoothness than has been typical with the prior art motor.

It is a more specific object of the present invention to provide an improved spool valve motor of the integral spool-output shaft type in which both the gerotor star and the spool-housing valve interface are varied to improve both volumetric and mechanical efficiency at relatively high pressure.

It is an even more specific object of the present invention to provide an improved spool valve gerotor motor in which, as each volume chamber approaches and recedes from being a transition chamber, there is additional means for fluid communication into and out of that volume chamber, thus increasing the flow capacity of the motor, or of the device when it is used as a pump.

The above and other objects of the invention are accomplished by the provision of a rotary fluid pressure device of the type including housing means having a fluid inlet port and a fluid outlet port. A fluid pressure operated displacement means is associated with the housing means, and includes an internally-toothed ring member, and an externally-toothed star member eccentrically disposed within the ring member for relative orbital and rotational movement therebetween to define a plurality of expanding and contracting fluid volume chambers in response to the orbital and rotational movements, and minimum and maximum volume transition chambers. A valve member cooperates with the housing means to provide fluid communication between the inlet port and the expanding volume chambers and between the contracting volume chambers and the outlet port. An output shaft is formed integrally with the valve member, and there is a drive shaft means for transmitting the rotational movement from the star member to the output shaft whereby, under relatively large torque loads, the drive shaft means is subject to a corresponding drive twist. The valve member and the housing means cooperate to define a nominal valve overlap.

The improved rotary fluid pressure device is characterized by the valve member and the housing means cooperating to define a valve overlap substantially greater than the nominal valve overlap. The externally-toothed star member defines, on its profile, a first plurality of recesses, each of the first recesses being disposed to permit fluid communication between the maximum volume transition chamber and the adjacent expanding volume chamber, as the transition chamber approaches maximum volume.

DETAILED DESCRIPTION OF THE PREFERRED EMBODIMENT

Figure 1:
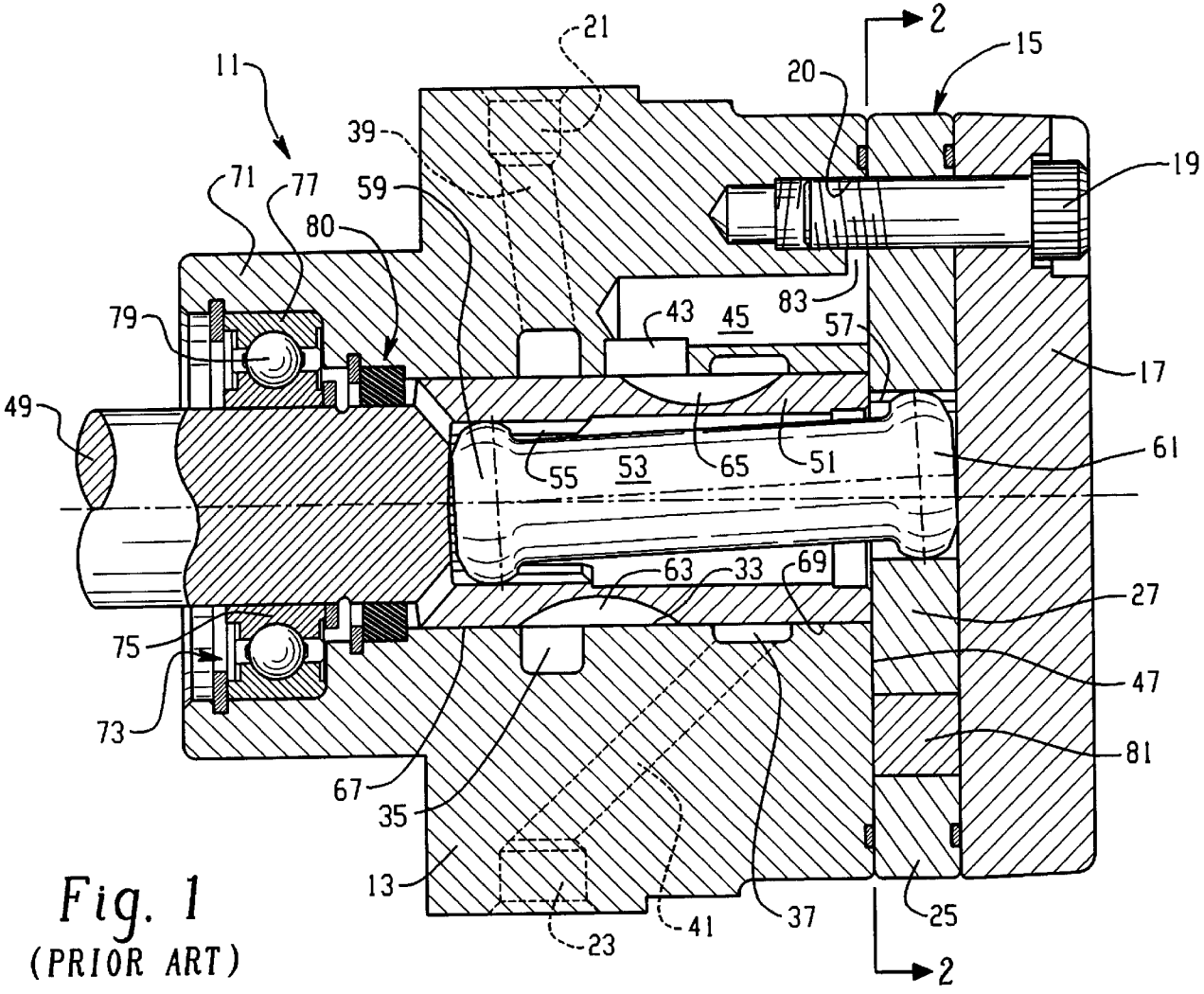
Fig. 1 (PRIOR ART)
FIG. 1 is an axial cross section of a spool valve gerotor motor of the type with which the present invention may be utilized.

Referring now to the drawings, which are not intended to limit the invention, FIG. 1 illustrates an axial cross section of a fluid motor of the type to which the present invention may be applied. The low-speed, high-torque motor, generally designated 11, is generally cylindrical and comprises several distinct sections. The motor 11 comprises a valve housing 13, a fluid energy-translating displacement mechanism 15 which, in the subject embodiment, is a roller gerotor gear set. Disposed adjacent the gear set 15 is an end cap 17, and the housing section 13, the gear set 15 and the end cap 17 are held together in fluid sealing engagement by a plurality of bolts 19 (only one of which is shown in FIG. 1). Each bolt 19 is received in a generally U-shaped notch 20, defined by the valve housing 13.

The valve housing section 13 includes a fluid port 21 and a fluid port 23. The gerotor gear set 15 includes an internally-toothed ring member 25, having internal teeth typically comprising rollers 81, through which the bolts 19 pass. The gear set 15 also includes an externally-toothed star member 27, each of the external teeth thereof bearing the reference "27*t*". The internal teeth 81 of the ring 25 and the star teeth 27*t* interengage to define a plurality of expanding fluid volume chambers 29, and a plurality of contracting fluid volume chambers 31 (see FIG. 2), as is well known in the art. Each of the fluid volume chambers 29 and 31 is in open fluid communication with one of the notches 20, through which the bolts 19 pass.

Those skilled in the art will understand that the designation of a volume chamber as "expanding" or "contracting" is in reference to its instantaneous, temporary condition, and a particular volume chamber is in one or the other of those conditions for less than half of one orbit of the star 27. As is also well known in the art, the interengagement of the teeth of the ring 25 and star 27 defines a minimum volume transition chamber 30 (see FIG. 4), and a maximum volume transition chamber 32 (see FIG. 5). As the names imply, the minimum volume transition chamber 30 occurs when a volume chamber changes (is in a "transition") from a contracting to an expanding volume chamber, and is at, or very near, its minimum volume. This occurs once for each volume chamber during each orbit of the star 27. Similarly, the maximum volume transition chamber 32 occurs when a volume chamber changes from an expanding to a contracting volume chamber, and is at, or very near, its maximum volume. This also occurs once for each volume chamber during each orbit of the star 27.

The valve housing 13 defines a spool bore 33, and a pair of annular grooves 35 and 37. The groove 35 is in fluid communication with the fluid port 21 by means of a passage 39, while the annular groove 37 is in fluid communication with the fluid port 23 by means of a passage 41 (the passages 39 and 41 being shown somewhat schematically in FIG. 1). The valve housing 13 defines a plurality of radial openings 43, each of which opens to the spool bore 33, and each opening 43 is in communication with an axial passage 45, which communicates to a rear surface 47 of the valve housing 13.

Disposed within the spool bore 33 is an output shaft assembly, including a shaft portion 49 and a spool valve portion 51. Disposed within the hollow, cylindrical spool valve 51 is a main drive shaft 53, commonly referred to as a "dogbone" shaft. The output shaft assembly defines a set of straight internal splines 55, and the star 27 defines a set of straight, internal splines 57. The drive shaft 53 includes a set of external crowned splines 59 in engagement with the internal splines 55, and a set of external, crowned splines 61 in engagement with the internal splines 57. As was noted in the BACKGROUND OF THE DISCLOSURE, the present invention is especially adapted for use with a device of the type which is subject to dogbone twist or wind-up, i.e., wherein the torque being transmitted by the dogbone has an effect on the timing of the motor valving.

The spool valve 51 defines a plurality of axial passages 63 in communication with the annular groove 35, and a plurality of axial passages 65 in communication with the annular groove 37. The axial passages 63 and 65 are also frequently referred to as "timing slots". As is generally well known to those skilled in the art, the timing slots 63 provide fluid communication between the annular groove 35 and the openings 43 disposed on one side of the line of eccentricity of the gerotor gear set 15, while the axial passages 65 provide fluid communication between the annular groove 37 and the openings 43 which are on the other side of the line of eccentricity. The resulting commutating valving action between the axial passages 63 and 65 and the openings 43, as the spool valve 51 rotates, is well known in the art. As is also well known to those skilled in the art, if the fluid port 21 is in communication with a source of pressurized fluid, and the fluid port 23 is in communication with a system reservoir, the output shaft 49 will rotate in one direction (assume clockwise), whereas, if the port 21 is connected to the reservoir and the port 23 is connected to the source of pressure, the output shaft 49 will rotate in the opposite direction (assume counterclockwise).

The spool valve 51 includes an annular forward journal surface 67 disposed adjacent the output shaft 49, and a rearward journal surface 69, disposed adjacent the rearward end of the spool valve 51. The valve housing 13 includes a forward bearing-receiving portion 71 which surrounds part of the output shaft 49. Disposed radially between the output shaft 49 and the bearing receiving portion 71 is a ball bearing set, generally designated 73, including an inner race 75, disposed on the output shaft 49, and an outer race 77, received within the portion 71. Disposed between the races 75 and 77 is a set of ball bearings 79.

Each bolt 19 and each axial passage 45 are radially aligned, and with each being disposed circumferentially between an adjacent pair of internal teeth or rollers 81. Furthermore, each passage 45 is in open fluid communication with the hole for the respective bolt 19 by means of a recess 83 (see FIG. 1), such that, between the passage 45 and the recess 83, there is ample opportunity for fluid communication into the expanding volume chambers 29, and out of the contracting volume chambers 31.

Figure 2:
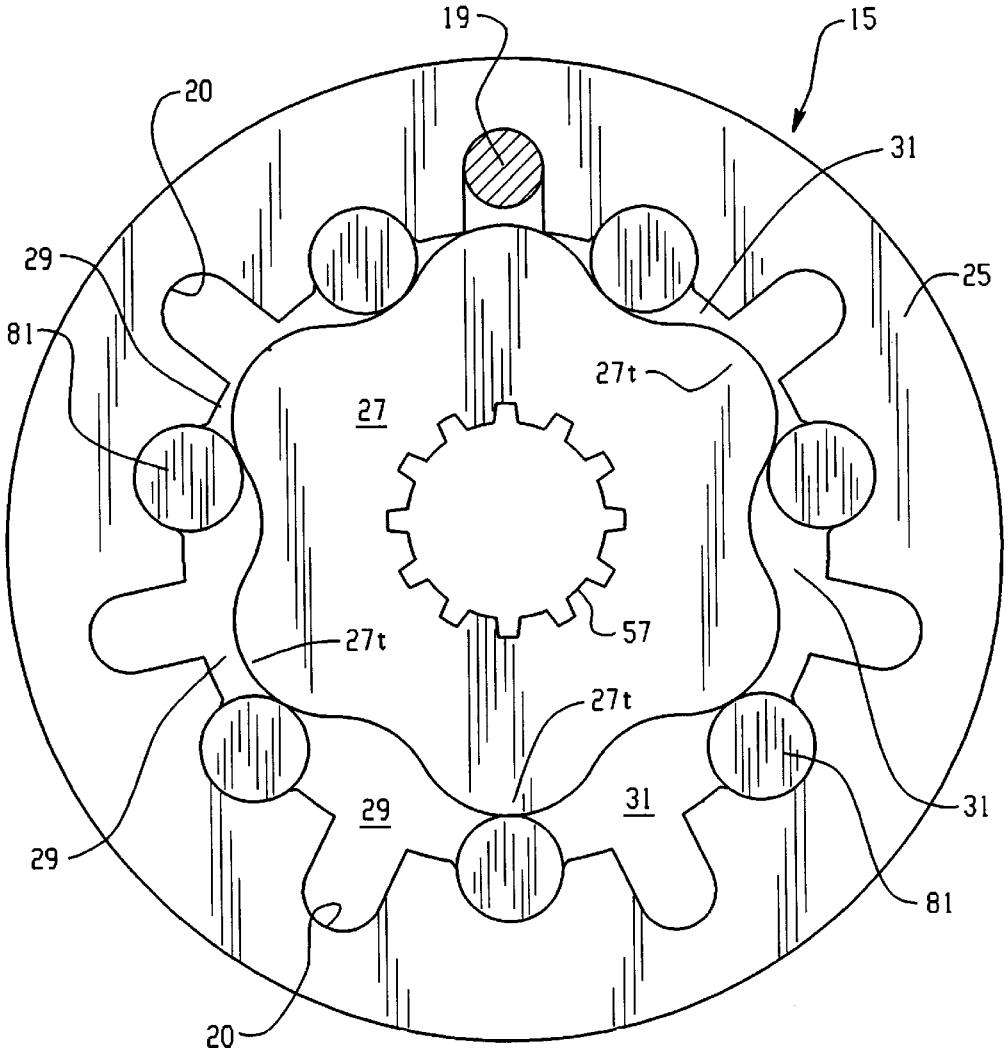
FIG. 2 is a transverse cross section taken on line 2—2 of FIG. 1, and on approximately the same scale.
Figure 3:
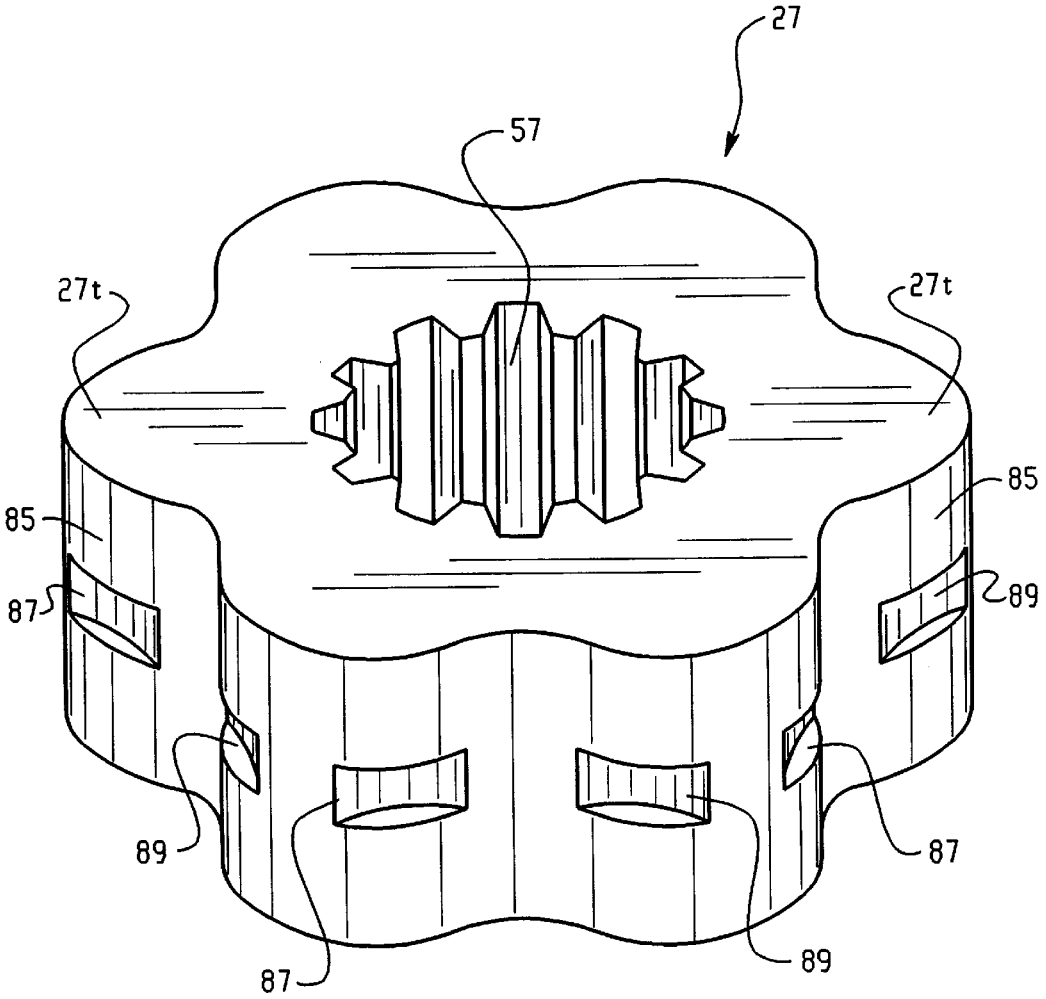
FIG. 3 is a perspective view of the gerotor star, including the transition recesses of the present invention, the particular gerotor star being shown in FIG. 3 having a somewhat greater axial dimension than that shown in FIG. 1.
Figure 4:
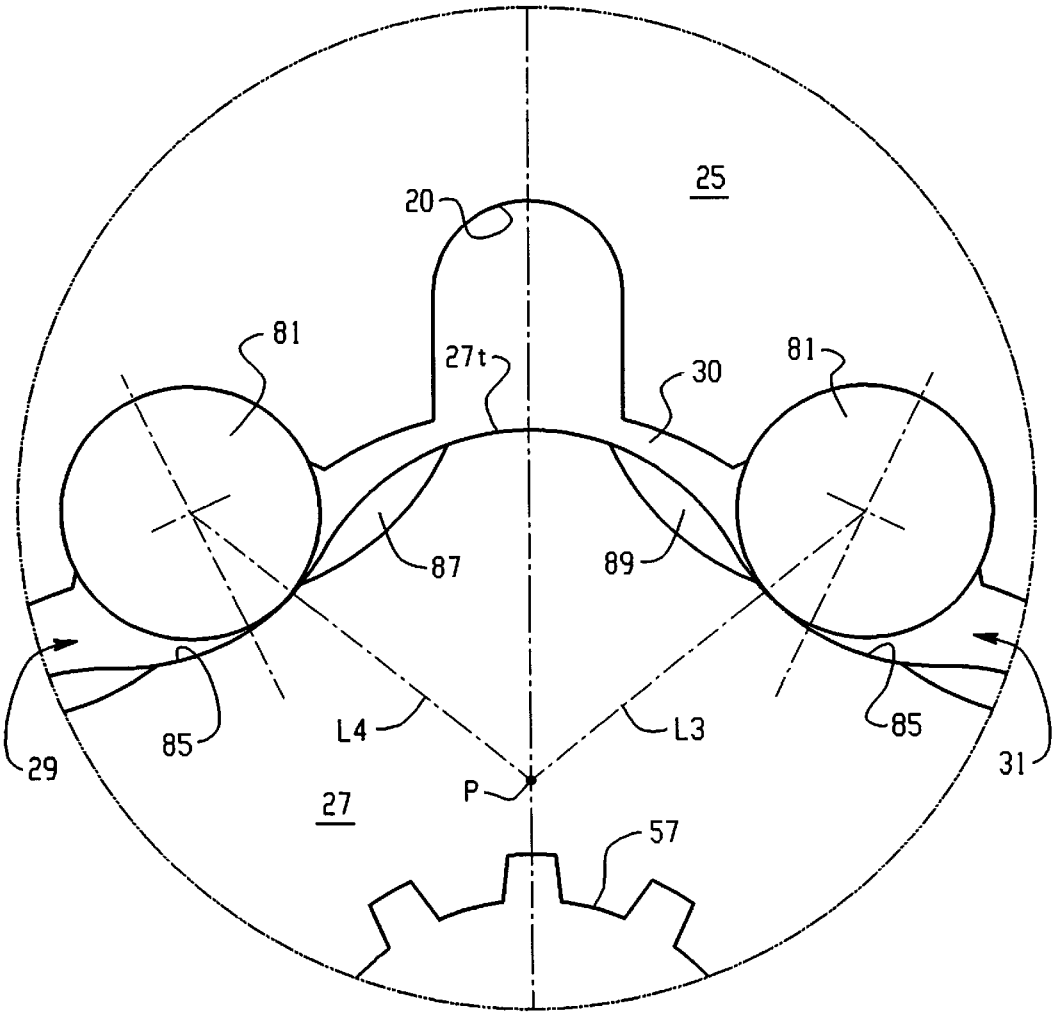
FIG. 4 is an enlarged, fragmentary, transverse cross section, similar to FIG. 2, illustrating a minimum volume transition chamber as it relates to the invention.
Figure 5:
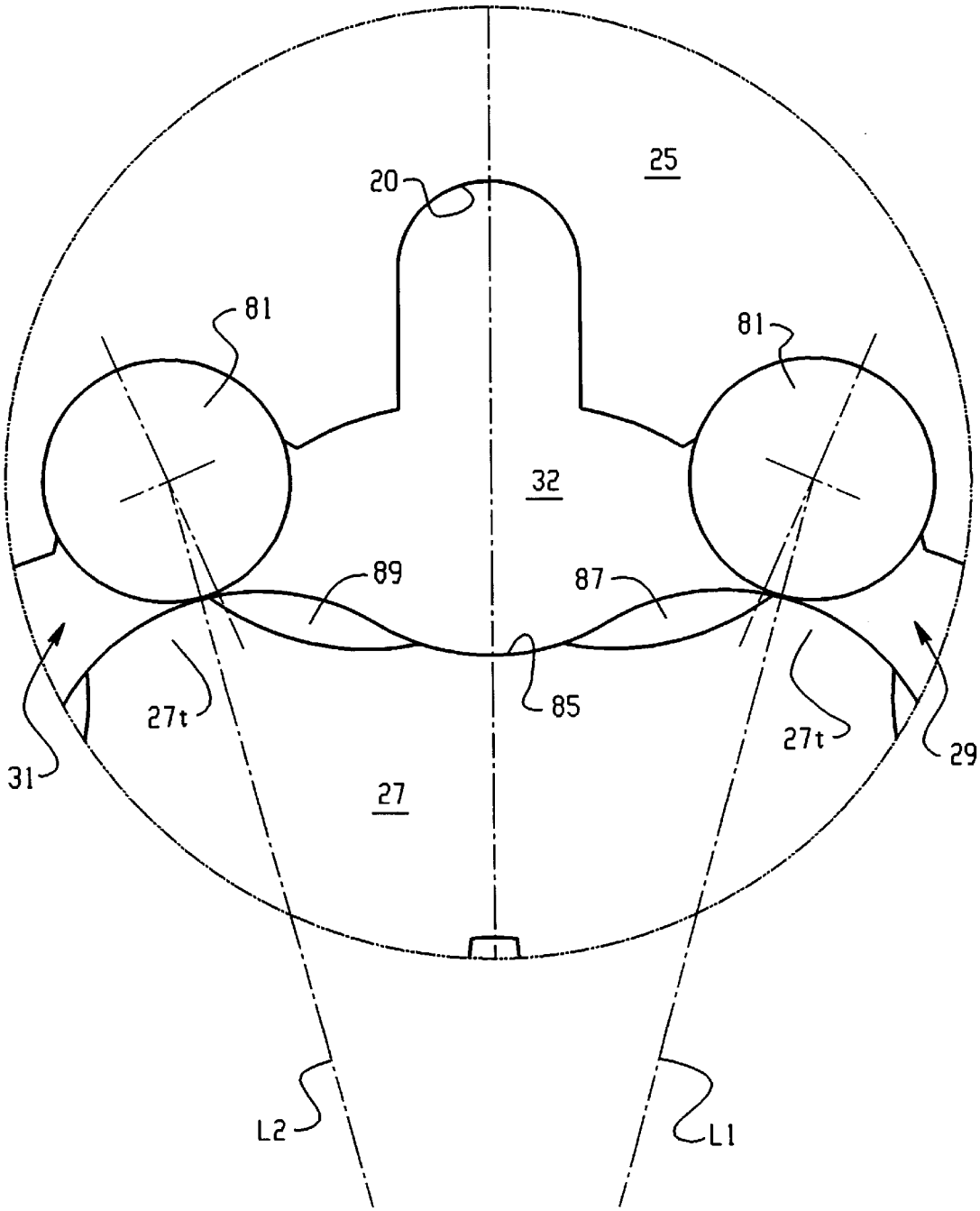
FIG. 5 is an enlarged, fragmentary, transverse cross section, similar to FIGS. 2 and 4, illustrating a maximum volume transition chamber as it relates to the invention.

Referring now primarily to FIGS. 3 and 5, the externally toothed star member 27 includes an outer surface 85, typically referred to as the "profile" of the star 27. It is the profile 85 which defines the external teeth 27*t*. It should be noted that in FIG. 3, the star member 27 is being viewed from the left end in FIG. 1, which is the same direction from which FIGS. 2, 4 and 5 are viewed.

The profile 85 of the star 27 defines two sets of recesses 87 and 89. Preferably, each of the recesses 87 or 89 is formed by use of a milling cutter, with each of the recesses being formed at generally the center (in an axial direction) of the respective star tooth 27*t*. As will be seen in the subsequent description, having the recesses 87 and 89 positioned as shown in FIG. 3 means that any pressurized fluid within the recesses will not exert any substantial axial force on the star 27. However, it should be understood that having the recesses 87 and 89 located in the center, axially, of the star profile 85 is not an essential feature of the invention, and depending upon the method of manufacture of the star 27, the recesses 87 and 89 could be located adjacent an end face of the star.

Those skilled in the art will also understand that, because the star profile 85 is usually larger than the diameter of the spool valve 51, there can be a larger tolerance on the recesses 87 and 89 than on the openings 43 and axial passages 63 and 65, and still achieve the same overall accuracy of valving action.

Referring now primarily to FIG. 5, in conjunction with FIG. 2, it should be noted that with the expanding volume chambers 29 being pressurized, and the contracting volume chambers 31 being in communication with the system reservoir, the star member 27 is orbiting in a clockwise direction, but is rotating in a counter-clockwise direction.

After the star 27 has orbited approximately 180° from the position shown in FIG. 2, the star 27 will be in the position shown in FIG. 5, in which the volume chamber at the 12 o'clock position becomes the maximum volume transition chamber 32. As is well known to those skilled in the art, the pattern of high pressure, expanding volume chambers 29 and low pressure, contracting volume chambers 31 rotates at the rotational speed of the star member 27. Thus, when the volume chamber at the 12 o'clock position becomes the maximum volume transition chamber 32, the adjacent volume chamber in the clockwise direction is a high pressure, expanding volume chamber 29, while the adjacent volume chamber in the counter-clockwise direction is a low pressure, contracting volume chamber 31.

Just before the star member 27 reaches the maximum volume transition position shown in FIG. 5, and for several degrees just after, the only movement, instantaneously, of the star member 27 is to pivot about a pivot point located somewhere between the roller 81 which is at the six o'clock position, and the "bottom" of the internal splines 57, as is well known to those skilled in the gerotor art.

In accordance with an important aspect of the present invention, the valving of fluid to and from the volume chambers is achieved at two different locations, each serving its own purpose. Reference should now be made also to the graph of FIG. 8.

1. The valving ("Main Flow Valving") which is accomplished between the spool 51 and the housing bore 33, and which is responsible for the majority of the flow into and out of the volume chambers, but which, because it is adversely effected by phenomena such as dogbone twist, is allowed to occur only when a volume chamber is very clearly either expanding (29) or contracting (31).

2. The valving ("Transition Valving") which occurs at the star, by means of the first recesses 87 and second recesses 89, and which is capable of communicating only a very small amount of flow, but which, because of its location on the star, is extremely accurate and is unaffected by phenomena external to the gerotor, such as dogbone twist, the clearance tolerance of the bolts in the gerotor ring, and spline backlash and wear.

Referring again primarily to FIG. 5, the extent to which the first recesses 87 extend toward the addendum of the teeth 27*t* is determined such that, just before the volume chamber at the 12 o'clock position becomes a maximum volume transition chamber 32 (i.e., from about 165 to about 176 degrees in FIG. 8), the recess 87 is in communication with the expanding volume chamber 29, i.e., the end of the recess 87 is disposed just slightly to the right of the pivot line L1 in FIG. 5. Then, at the instant when the volume chamber achieves the transition chamber condition shown in FIG. 5, the recess 87 is out of communication with the expanding volume chamber 29, i.e., it lies wholly to the left of the line L1 ("All Valving Closed" in FIG. 8).

Figure 8:
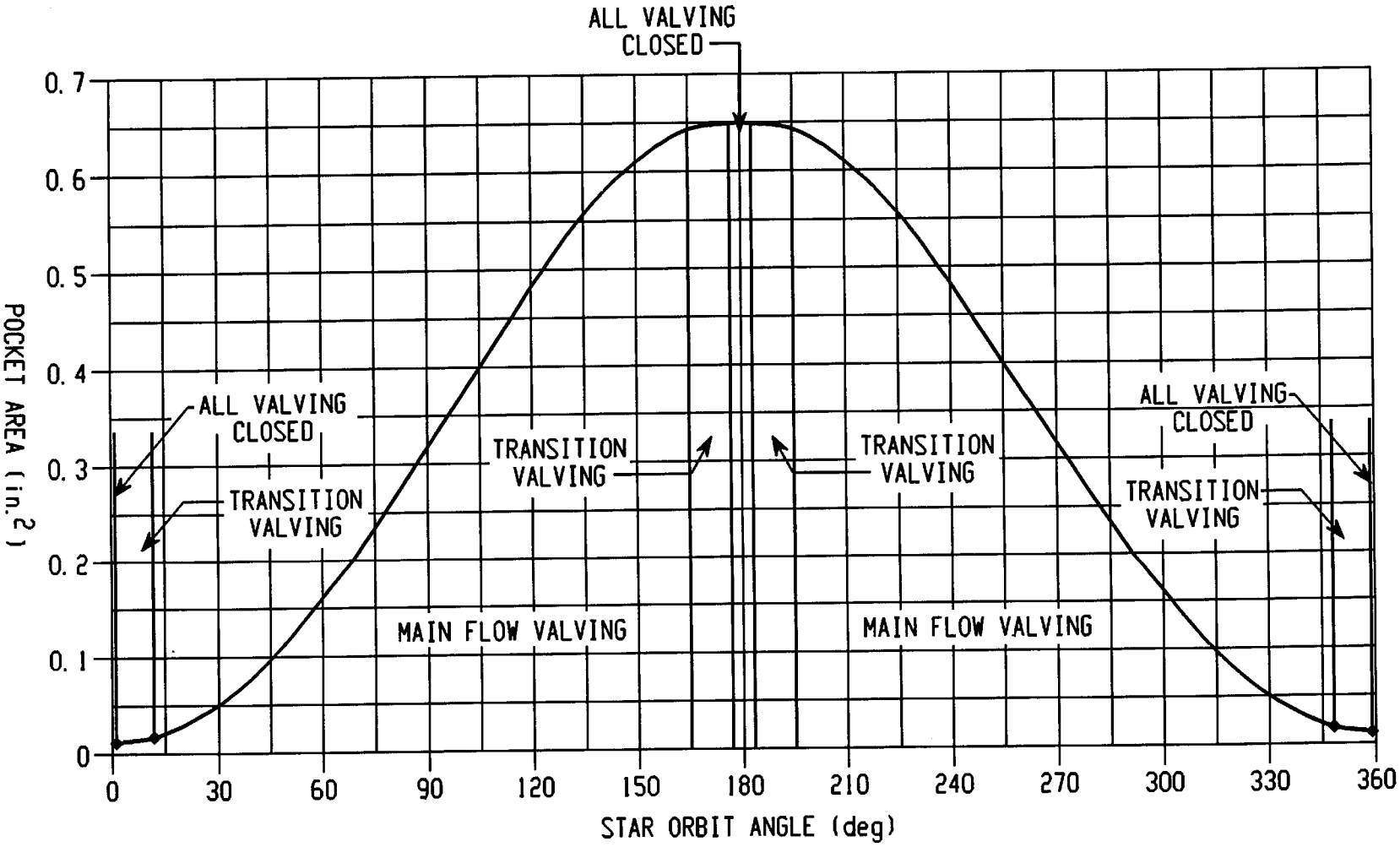
FIG. 8 is a graph of volume chamber Pocket Area vs. Star Orbit Angle, illustrating the operation of the present invention.

Similarly, the second recesses 89 each extend toward the addendum of the tooth 27*t* far enough so that, as the volume chamber becomes the maximum volume transition chamber 32, the recess 89 is located at or nearly at the pivot line L2, such that, as soon as the volume chamber at the twelve o'clock position begins to contract, the tip of the recess 89 is disposed to the left of the line L2, thus providing communication between the chamber 32 and the adjacent contracting volume chamber 31 (i.e., from about 184 degrees to about 195 degrees in FIG. 8). All valving is closed ("All Valving Closed" in FIG. 8), and there is effectively no fluid communication to or from the volume chamber 32 from about 176 degrees to about 184 degrees, or about 8 degrees of orbiting of the star 27.

Thus, just before the chamber 32 reaches maximum volume, pressurized fluid is communicated from the expanding volume chamber 29 through the recess 87 into the chamber 32, and then as soon as the chamber 32 begins to contract, pressurized fluid is communicated out through the recess 89 into the contracting volume chamber 31. As a result, there is no vacuum or void drawn in the chamber 32 as it reaches maximum volume, and there is no pressure pulse or spike as it begins to contract, such that the orbital and rotational movement of the star 27 is smooth and quiet.

Referring now primarily to FIG. 4, which corresponds to the twelve o'clock position of FIG. 2, when the star member 27 is in the minimum volume transition condition shown in FIG. 4, the star member 27 pivots instantaneously about a point P. At this instant, the minimum volume transition chamber 30 is bounded on the right side by the contact between the roller 81 and the profile 85 at a point where a contact line L3 passes through, and is bounded on the left side by the contact between that roller 81 and the profile 85 at a point where a contact line L4 passes through.

The extent to which each of the recesses 89 extends into the "valley" of the star is such that, just before the chamber 30 reaches the minimum volume condition, a portion of the recess 89 extends below the line L3 and is in communication with the adjacent contracting volume chamber 31 (e.g., from about 348 degrees to about 358 degrees in FIG. 8). As a result, fluid which is trapped in the minimum volume transition chamber 30 is communicated through the recess 89 to the chamber 31 until the chamber 30 actually reaches its minimum volume.

The extent to which each of the recesses 87 extends into the valley of the star is such that, when the chamber 30 is at its minimum volume condition shown in FIG. 4, the recess 87 extends up to, or nearly up to the line L4. Therefore, as soon as the chamber 30 passes the minimum volume position and begins to expand, the leading edge of the recess 87 moves past the line L4 and begins to communicate with the expanding volume chamber 29 (i.e., from about 2 degrees to about 12 degrees in FIG. 8), such that pressurized fluid is communicated through the recess 87 into the chamber 30, which is now beginning to expand.

Therefore, in the same manner as was described in connection with the maximum volume transition chamber 32, as the minimum volume transition chamber 30 approaches the minimum volume position, there will be no fluid trapped in the chamber 30, and therefore no pressure pulses or spikes, and as the chamber 30 begins to expand, there will be no vacuum or void occurring. Thus, the orbital and rotational motion of the star member 27 will be smooth and quiet as each volume chamber goes through the transition from being a contracting volume chamber 31 to being an expanding volume chamber 29. It should be noted in viewing FIGS. 4 and 5 that there is symmetry of the recesses 87 and 89, relative to the various lines L1, L2, L3, and L4, such that, as illustrated and described, the motor may be operated in either direction of rotation (and flow) and the mode of operation and performance of the recesses 87 and 89 will be the same as described above.

Figure 6:
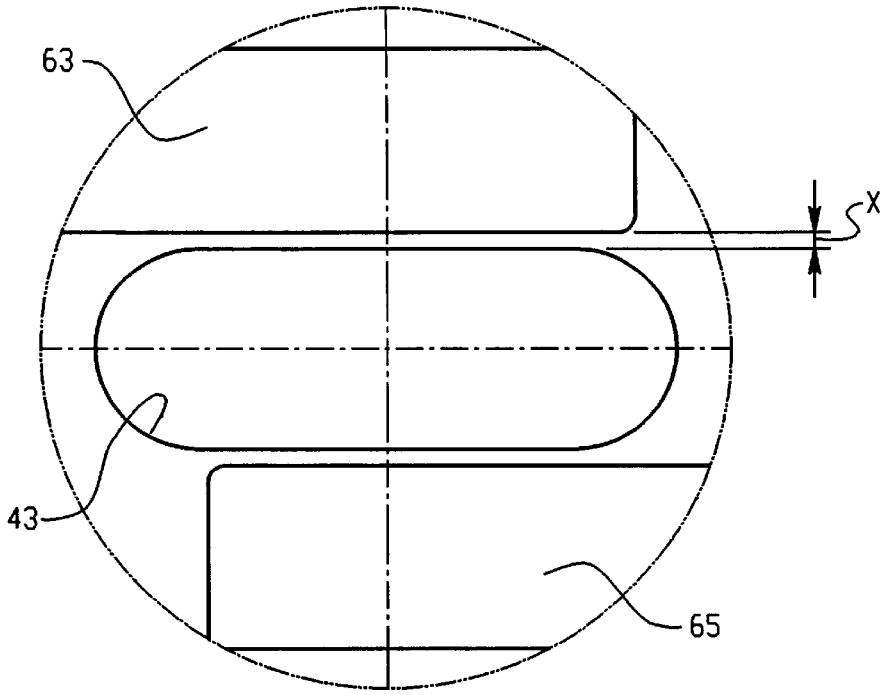
Fig. 6 (PRIOR ART)
FIG. 6 is an enlarged, fragmentary, flat layout view of the prior art valving.
Figure 7:
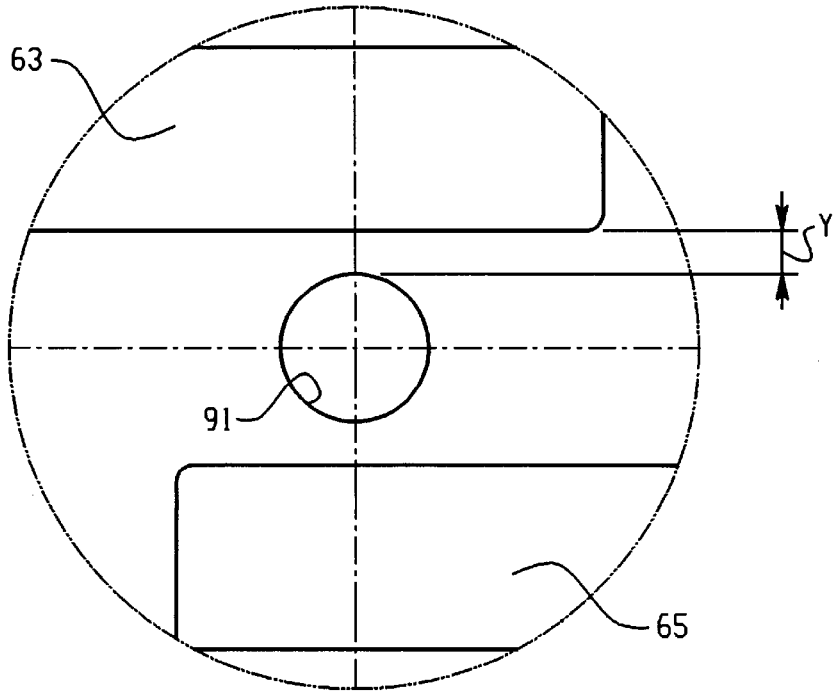
FIG. 7 is an enlarged, fragmentary, flat layout view of the valving modified in accordance with one aspect of the present invention.

Referring now primarily to FIGS. 6 and 7, in conjunction with FIG. 1, another important aspect of the present invention will be described. As is well known to those skilled in the art of spool valve motors, as the spool 51 rotates, each of the commutation openings 43 (see FIG. 6) engages in commutating fluid communication with the axial passages 63 and 65 defined by the spool 51. During such commutation, each opening 43 instantaneously passes through a position as shown in FIG. 6 in which it is centered between an adjacent passage 63 and an adjacent passage 65, such that the opening 43 cooperates with each adjacent passage 63 or 65 to define an overlap "X". The "overlap" is actually the circumferential dimension of the sealing land between the opening 43 and passage 63 (or 65) when the opening 43 is in the centered position shown in FIG. 6.

As a result of tolerance requirements and thermal shock requirements, it is necessary to provide a certain radial clearance between the housing bore 33 and the outside diameter of the spool valve 51. This well known radial clearance, in turn, necessitates the overlap condition described above, but such overlap detracts from the mechanical efficiency of the motor because of the resulting cavitation and/or trapping of fluid which can occur at the minimum and maximum volume transition conditions described above. It is a feature of the present invention that the overlap may be increased, thus improving volumetric efficiency, but without reducing the mechanical efficiency, as would have been the case with the prior art. Instead, the mechanical efficiency is also increased.

Theoretically, the position of the opening 43 in FIG. 6 is the position in which the opening is supposed to be at the instant when its respective volume chamber becomes the minimum volume transition chamber 30 shown in FIG. 4. However, as was discussed in the background of the disclosure, the occurrence of dogbone twist when the motor is operating under high torque loads will result in the opening 43 not being centered as shown in FIG. 6, but instead, the opening 43 will still be in communication with the axial passage 63 containing high pressure. As a result, just as the volume chamber associated with the opening 43 reaches its minimum volume transition position, it will still be in communication with return pressure, and (without the present invention) the volume chamber will then begin to increase, but without being in communication yet with high pressure, the result will be cavitation within the motor.

Therefore, in accordance with an important aspect of the present invention, each of the commutating openings 43 of the "PRIOR ART" is replaced by a commutation opening 91 (see FIG. 7), which, in the subject embodiment, comprises a circular bore rather than an elongated opening. More importantly, the commutation opening 91 is sized such that, when it is in the centered position between an adjacent passage 63 and an adjacent passage 65, the opening 91 cooperates with each of the adjacent passages to define an overlap "Y" which is substantially greater than the PRIOR ART overlap X. By way of example only, the overlap Y in the subject embodiment is in the range of three to four times the overlap X of the PRIOR ART device. As a result, under high torque loads, if there is a substantial twist of the dogbone shaft 53, there will still not be any fluid communication between the passage 63 and the commutation opening 91 as the volume chamber associated with this particular opening 91 reaches its minimum volume transition condition.

Those skilled in the art will understand that the greater overlap Y as shown in FIG. 7 will not adversely effect the communication of fluid to and from expanding and contracting volume chambers, and will not result in an undesirable increase in the pressure drop across the motor, in view of the presence of the recesses 87 and 89, and the way in which they supplement the main valving function of the spool valve 51, approaching and passing the minimum and maximum volume transition conditions. It is believed to be within the ability of those skilled in the art to select the overlap Y, based upon a knowledge of the rated torque of the motor, and by calculating the amount of dogbone twist which occurs at the rated torque. Furthermore, it is within the ability of those skilled in the art, from a reading and understanding of this specification, to select the specific boundaries of the recesses 87 and 89, for any given gerotor geometry.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type including housing means having a fluid inlet port and a fluid outlet port; fluid pressure-operated displacement means associated with said housing means, and including an internally-toothed ring member, and an externally-toothed star member eccentrically disposed within said ring member for relative orbital and rotational movement therebetween to define a plurality of expanding and contracting fluid volume chambers in response to said orbital and rotational movements, and minimum and maximum volume transition chambers; a valve member cooperating with said housing means to provide fluid communication between said inlet port and said expanding volume chambers and between said contracting volume chambers and said outlet port; an output shaft formed integrally with said valve member, and drive shaft means for transmitting said rotational movement from said star member to said output shaft whereby, under relatively large torque loads, said drive shaft means is subject to a corresponding drive twist; said valve member and said housing means cooperating to define a nominal valve overlap; said device being characterized by:

(a) said valve member and said housing means cooperating to define a valve overlap substantially greater than said nominal valve overlap; and, (b) said externally-toothed star member defining, on its profile, a first plurality of recesses, each of said first recesses being disposed to permit fluid communication between said maximum volume transition chamber and the adjacent expanding volume chamber, as said transition chamber approaches maximum volume.

2. A rotary fluid pressure device as claimed in claim 1, characterized by said valve member comprising a spool valve having a cylindrical outer surface disposed within a spool bore defined by said housing means.

3. A rotary fluid pressure device as claimed in claim 1, characterized by said externally-toothed star member defining, on its profile, a second plurality of recesses, each of said second recesses being disposed to permit fluid communication between said maximum volume transition chamber and the adjacent contracting volume chamber, as said transition chamber passes maximum volume.

4. A rotary fluid pressure device as claimed in claim 1, characterized by each of said second plurality of recesses being disposed to permit fluid communication between said minimum volume transition chamber and the adjacent contracting volume chamber as said transition chamber approaches minimum volume.

5. A rotary fluid pressure device as claimed in claim 1, characterized by each of said first plurality of recesses being disposed to permit fluid communication between said minimum volume transition chamber and the adjacent expanding volume chamber as said transition chamber passes minimum volume.

6. A rotary fluid pressure device as claimed in claim 1, characterized by said valve overlap being selected such that, when said drive shaft means is subjected to said drive twist, said valve member and said housing means still define a sealing land therebetween.

* * * * *